US011000720B1

(12) United States Patent
Chen

(10) Patent No.: US 11,000,720 B1
(45) Date of Patent: May 11, 2021

(54) FAN VEHICLE WITH ADJUSTABLE RESISTANCE

(71) Applicant: CHANG YOW TECHNOLOGIES INTERNATIONAL CO., LTD., Taichung (TW)

(72) Inventor: Chao-Chuan Chen, Taichung (TW)

(73) Assignee: Chang Yow Technologies International Co., Ltd., Taichung (TW)

( * ) Notice: Subject to any disclaimer, the term of this patent is extended or adjusted under 35 U.S.C. 154(b) by 8 days.

(21) Appl. No.: 16/697,860

(22) Filed: Nov. 27, 2019

(30) Foreign Application Priority Data

Oct. 31, 2019 (TW) ..... 108139551

(51) Int. Cl.

| | |
|---|---|
| ***A63B 21/008*** | (2006.01) |
| ***A63B 21/005*** | (2006.01) |
| ***A63B 21/00*** | (2006.01) |
| ***A63B 21/22*** | (2006.01) |
| ***A63B 22/06*** | (2006.01) |

(52) U.S. Cl.
CPC ..... *A63B 21/0088* (2013.01); *A63B 21/0052* (2013.01); *A63B 21/00069* (2013.01); *A63B 21/154* (2013.01); *A63B 21/225* (2013.01); *A63B 22/0605* (2013.01); *A63B 2022/0611* (2013.01)

(58) Field of Classification Search
CPC ..... A63B 22/06–0694; A63B 21/005–0055; A63B 21/0085–0088
See application file for complete search history.

(56) References Cited

U.S. PATENT DOCUMENTS

| | | | | |
|---|---|---|---|---|
| 9,586,087 | B1 * | 3/2017 | Lin | A63B 22/0664 |
| 2006/0160669 | A1 * | 7/2006 | Lizarralde | A63B 21/0051 482/63 |
| 2010/0022353 | A1 * | 1/2010 | Hsiao | A63B 21/0053 482/2 |
| 2017/0274237 | A1 | 9/2017 | Chang | |
| 2018/0185700 | A1 * | 7/2018 | Xing | A63B 21/0058 |
| 2019/0083839 | A1 * | 3/2019 | Wang | A63B 22/06 |
| 2019/0255376 | A1 * | 8/2019 | Wu | A63B 21/00076 |

* cited by examiner

*Primary Examiner* — Jennifer Robertson

(74) *Attorney, Agent, or Firm* — Muncy, Geissler, Olds and Lowe, P.C.

(57) ABSTRACT

A fan vehicle includes a driving wheel, a wind resistance wheel, a resistance unit and a power generating unit. The driving wheel can be driven by two pedals. The wind resistance wheel is connected to the driving wheel via a transmission unit in order to rotate synchronously. The resistance unit includes a mandrel, a flywheel installed on the mandrel and connected to the transmission unit, a magnetic ring mounted onto the flywheel and a magnet securement rack installed on the outer perimeter of the flywheel. One side of the magnet securement rack includes a plurality of magnets. The magnet securement rack can be pulled by a cable in order to change the distance of the magnets relative to the magnetic ring in order to adjust the magnitude of the magnetic resistance. The power generating unit is installed inside the flywheel.

6 Claims, 12 Drawing Sheets

FAN VEHICLE WITH ADJUSTABLE RESISTANCE

BACKGROUND OF THE INVENTION

1. Field of the Invention

The present invention relates to a fitness apparatus, in particular, to fan vehicle with an adjustable resistance.

2. Description of the Related Art

In general, a conventional fan vehicle mainly provides two foot pedals on the left and right sides for foot stepping, and the two left and right pedals are able to drive a wind resistance wheel to rotate via a transmission element, such as chain or belt etc., thereby utilizing the rotating resistance generated from the wind resistance wheel to achieve the effect of work out and exercise. Nevertheless, such traditional fan vehicle cannot provide the function for adjusting the rotating resistance of the wind resistance wheel, and relevant prior art, such as US Patent Publication No. 2017/0274237, describes such issue; consequently, it is insufficient to satisfy the demands of different users.

SUMMARY OF THE INVENTION

The primary objective of the present invention is to provide fan vehicle, capable of using the wind resistance and magnetic resistance in combination to achieve high intensity and diverse training effect. In addition, it is able to achieve the demands of different users according to actual adjustment of the magnitude of the resistance.

To achieve the foregoing objective, the present invention provides a fan vehicle, comprising a chassis; a driving unit, a wind resistance wheel, a transmission unit, a resistance unit and a power generating unit. The driving unit includes a crankshaft, a driving wheel, two pedals and two cranks. The crankshaft is rotatably installed on the chassis. The driving wheel is secured onto the crankshaft and positioned on one side of the chassis. One ends of the two cranks are connected to the crankshaft and another ends of the two cranks are connected to the two pedals, in order to allow the driving wheel to driven by the two pedals to rotate. The wind resistance wheel is rotatably installed on the chassis and positioned at a front of the driving unit in order to provide the wind resistance effect. The transmission unit is connected to the driving wheel and the wind resistance wheel and is configured to transmit a driving force generated by the driving wheel to the wind resistance wheel, thereby allowing the wind resistance wheel to rotate with the driving wheel synchronously. The resistance unit includes a mandrel, a flywheel, a magnetic ring, a magnet securement rack, a plurality of first magnets, an elastic member and a cable. The mandrel is installed on the chassis and positioned at a rear of the driving unit. The flywheel is rotatably installed on the mandrel and connected to the transmission unit. The magnetic ring is secured onto an outer circumferential surface of the flywheel. The magnet securement rack is positioned at an outer perimeter of the magnetic ring, and a top end of the magnet securement rack pivotally attached onto the chassis. The plurality of first magnets are arranged spaced apart from each other on one side of the magnet securement rack facing toward the magnetic ring and forming a gap away from the magnetic ring. The elastic member acts on a bottom end of the magnet securement rack and exerts an elastic force on the magnet securement rack to push toward a direction of the magnetic ring. One end of the cable is connected to the bottom end of the magnet securement rack and is configured to provide a traction force to pull the magnet securement rack in a direction away from the magnetic ring. Accordingly, by changing the distance of the magnetic securement rack relative to the magnetic ring, the intensity of the magnetic field can be adjusted, allowing the resistance unit to provide different level of resistance effect to the flywheel. The power generating unit includes a plurality of second magnets, a supporting rack, a plurality of cores and a plurality coils. The plurality of second magnets are installed inside the flywheel and arranged in a ring shape relative to the mandrel. The supporting rack is secured onto the mandrel and positioned inside the flywheel. The plurality of cores are installed on an outer circumferential edge of the supporting rack and forming a gap away from an inner circumferential surface of the plurality of second magnets. The plurality of coils are wounded onto the plurality of cores one-to-one respectively. When the plurality of second magnets are rotated along with the flywheel relative to the plurality of coils, the plurality of coils are able to generate an induced current, thereby achieve the effect of self-generating electricity.

In view of the above, it can be understood that the fan vehicle of the present invention is able to utilize the combined effect of wind resistance and magnetic resistance in order to allow users to perform high intensity and diverse trainings as well as to allow users to complete trainings at low rotational speed and high power output. Moreover, users can also perform setting of the magnitude of the magnetic resistance on his or her own according to individual needs while achieving the effect of self-generating electricity.

Preferably, the transmission unit includes a supporting axle, a transmission sleeve, a first sprocket wheel a second sprocket wheel, a belt pulley; the supporting axle is secured onto the chassis. The transmission sleeve is rotatably installed on the supporting axle; the first sprocket wheel and the second sprocket wheel are connected to two ends of the transmission sleeve and positioned between the driving wheel and the wind resistance wheel. The first sprocket wheel uses a first chain to connect to the driving wheel, and the second sprocket wheel uses a second chain to connect to the wind resistance wheel. The belt pulley is positioned at the second sprocket wheel and facing toward one side of the first sprocket wheel and connected to one end of the transmission sleeve and is also connected to the flywheel through a transmission belt. Accordingly, when the driving wheel rotates, the first sprocket wheel is driven by the first chain, following which the first sprocket wheel then drives the second sprocket wheel and the belt pulley via the transmission sleeve, allowing the second sprocket wheel to drive the wind resistance wheel via the second chain, and allowing the belt pulley to drive the flywheel via the transmission belt. Consequently, the effect of synchronous actions of the driving wheel, the wind resistance wheel and the flywheel can be achieved.

Preferably, the transmission unit further includes an idler wheel. The idler wheel is rotatably installed on the chassis and is adjacent to the flywheel, and abuts against the transmission belt, allowing the transmission belt to be maintained with a sufficient tension.

Preferably, two left and right ends of the mandrel include a rear supporting plate secured thereon. The rear supporting plate includes a linear hole and a retaining portion positioned at a top of the linear hole; the idler wheel is rotatably installed on a wheel axle. The wheel axle penetrates into the linear hole to move upward and downward therein. The transmission unit further includes an adjustment member, an adjustment nut and a retaining nut. The adjustment member includes a collar and a screw shaft connected to the collar. The collar of the adjustment member is mounted onto the wheel axle; the screw shaft of the adjustment member penetrates into the retaining portion of the rear supporting plate to move upward and downward therein. The adjustment nut is fastened onto the screw shaft and positioned on top of the retaining portion of the rear supporting plate. The retaining nut is fastened on the screw shaft and positioned underneath the retaining portion of the rear supporting plate. Accordingly, the screw shaft of the adjustment member can be driven by simply rotating the adjustment nut, allowing the adjustment member to drive the wheel axle to move upward and downward along the linear hole via the collar, thereby driving the idler wheel to move upward and downward. Consequently, the tension of the transmission bit can be adjusted.

More information about the configuration, features, assembly and uses of the present invention will be provided in the following description in detail. However, people skilled in the art shall appreciate that the detailed description and embodiments as well as aspects are for illustration only, and by no means intended to limit the scope of the present invention.

DETAILED DESCRIPTION OF THE INVENTION

Figure 1:
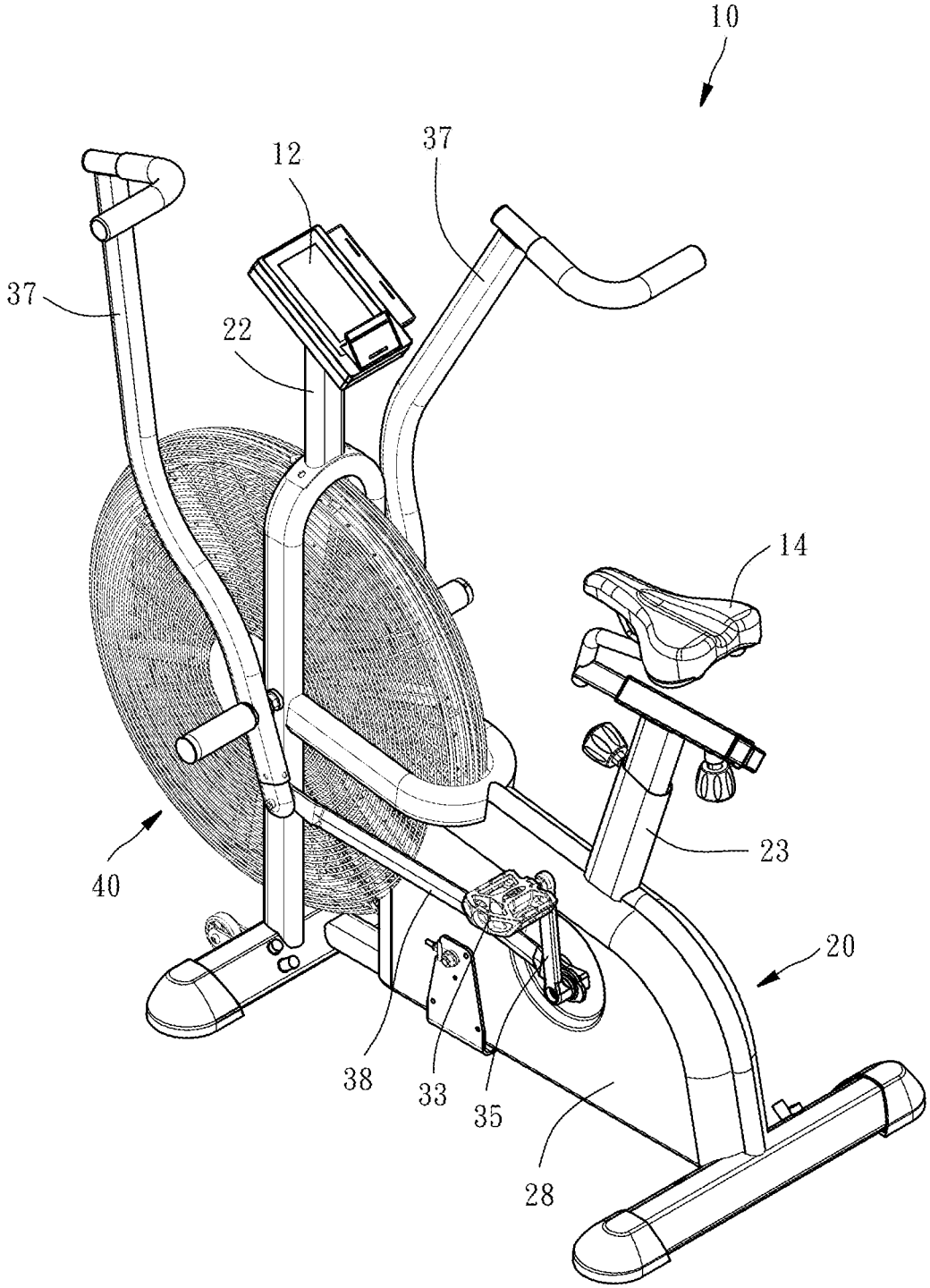
FIG. 1 is a perspective view of the fan vehicle the present invention.

The Applicant first emphasizes that in this entire specification, including the embodiments and the claims described in the following, all terms related to directions are based on the directions disclosed in the drawings. In addition, in the embodiments and drawings described in the following, identical component signs refer to the same or similar elements or structural characteristics thereof.

Please refer to FIG. 1 to FIG. 3, FIG. 5 and FIG. 7. The fan vehicle 10 of the present invention comprises a chassis 20, a driving unit 30, a wind resistance wheel 40, a transmission unit 50, a resistance unit 70 and a power generating unit 80.

Figure 10:
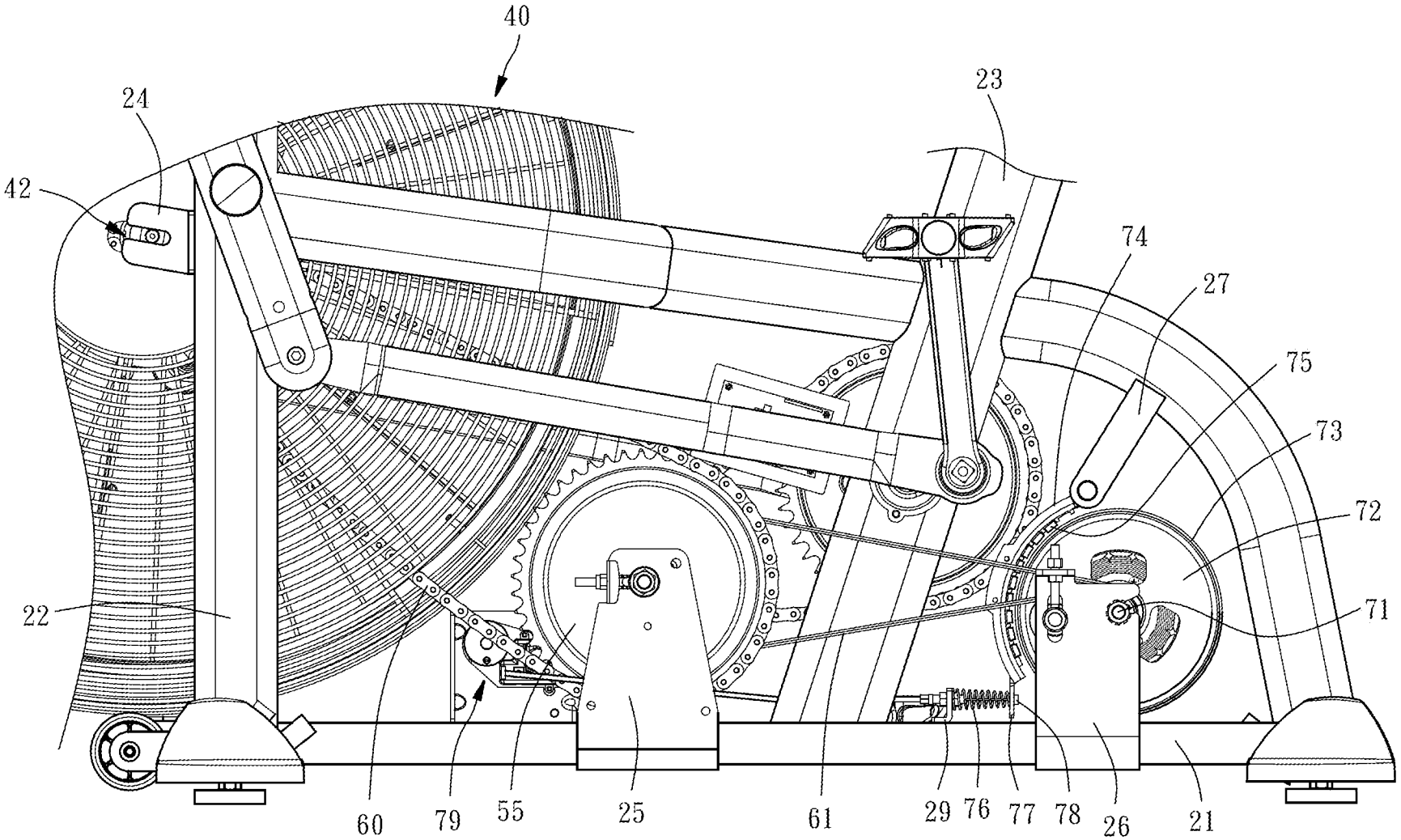
FIG. 10 is a partially enlarged left view of the fan vehicle without the outer casing of the present invention.

The chassis 20 includes a base 21. The front end of the base 21 includes a column 22. The top end of the column 22 is provided with a control panel 12. The center of the base 21 includes a seat bar 23, and the top end of the seat bar 23 is provided with a seat 14. In addition, as shown in FIG. 10, the chassis 20 further includes a front supporting plate 24, a central supporting plate 25 and a rear supporting plate 26. The front supporting plate 24 is secured onto the center of the column 22, the central supporting plate 25 is secured onto the base 21 and positioned between the column 22 and the seat bar 23, and the rear supporting plate 26 is secured onto the base 21 and positioned at the ear of the seat bar 23. The chassis 20 further includes two side plates 28 attached onto each other. The two side plates 28 are able to accommodate a portion of the driving unit 30, the transmission unit 50, the resistance unit 70 and the power generating unit 80 therein in order to provide the protection effect.

Figure 3:
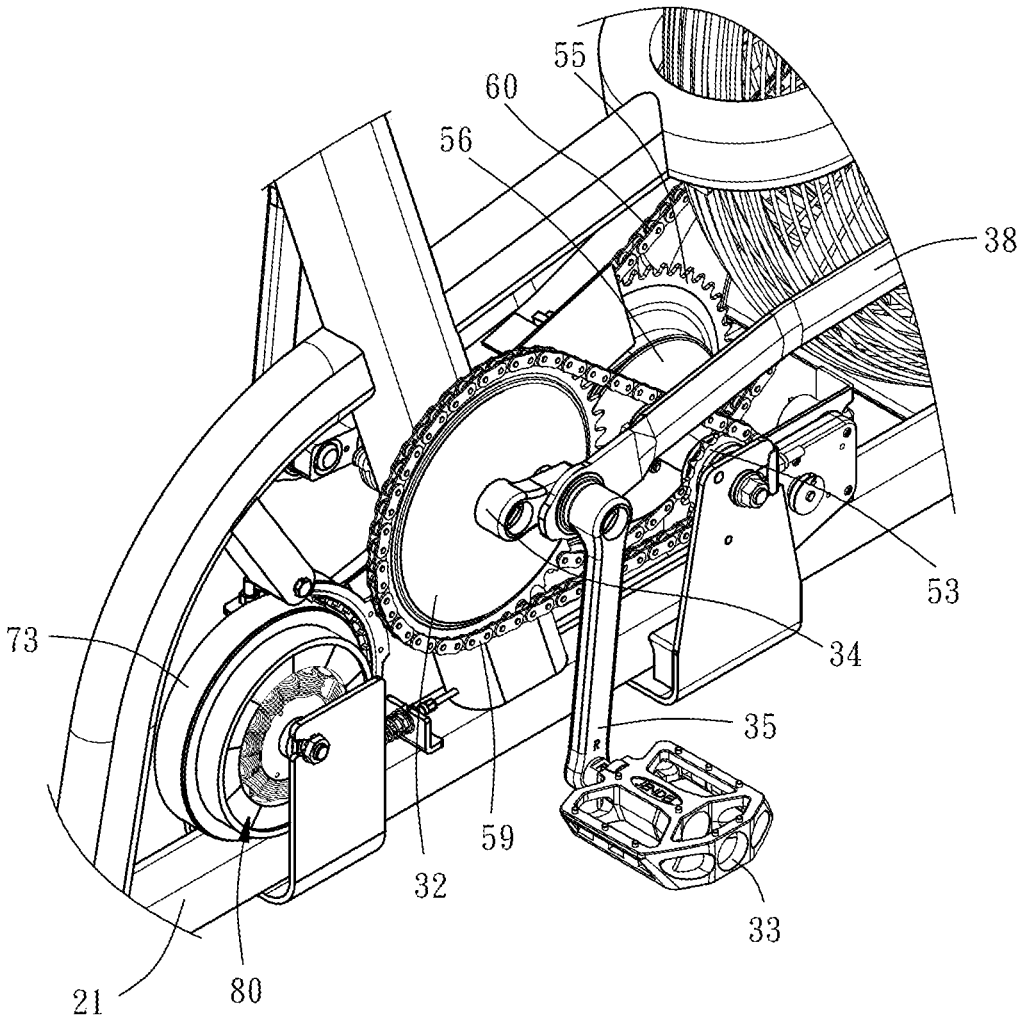
FIG. 3 is a partially enlarged view mainly illustrating a view similar to FIG. 2 from another angle.
Figure 4:
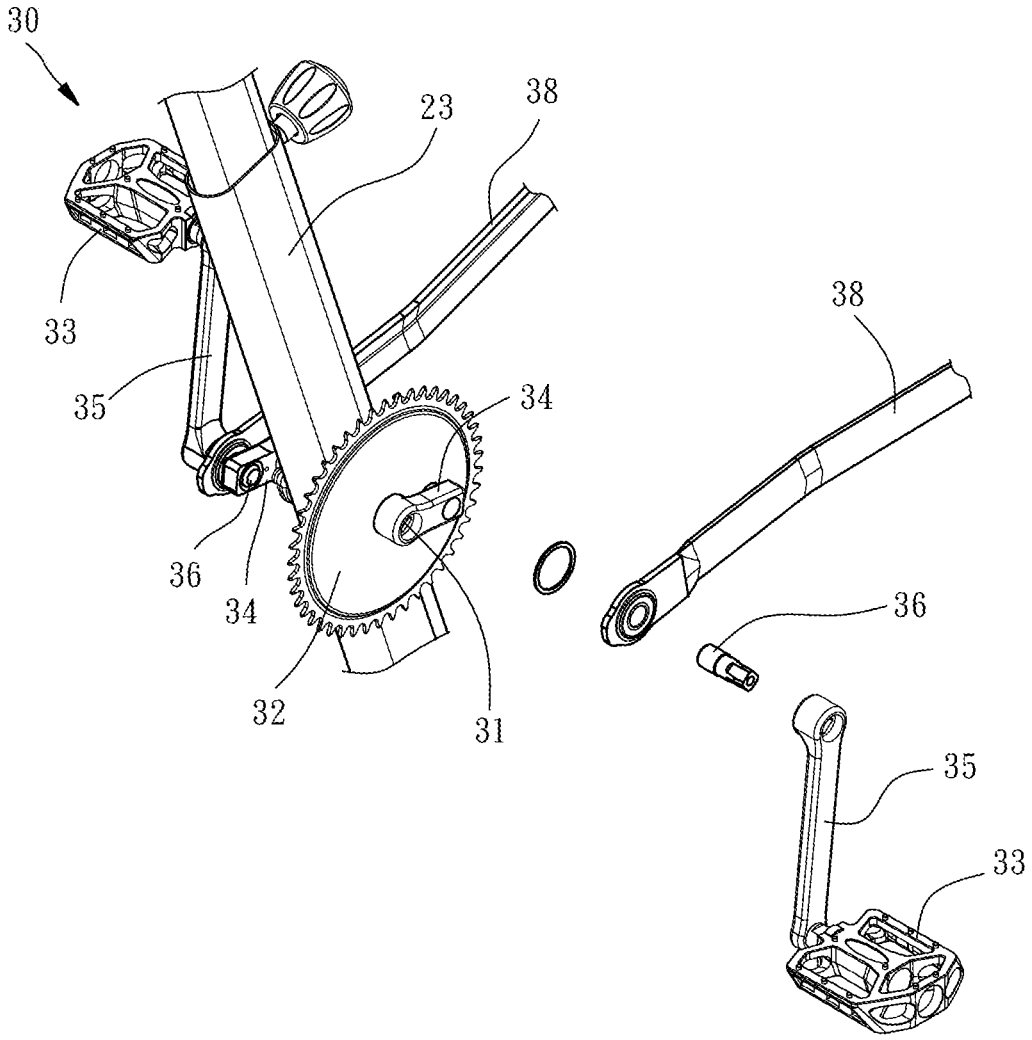
FIG. 4 is a partial perspective exploded view of the driving unit provided by the present invention.

The driving unit 30 includes a crankshaft 31, a driving wheel 32, two pedals 33, two inner cranks 34 and two outer cranks 35. As shown in FIG. 4, the crankshaft 31 is rotatably installed on the seat bar 23. The driving wheel 32 is secured onto the crankshaft 31 and positioned on the right side of the seat bar 23. One ends of the two inner cranks 34 are connected to the crankshaft 31 and another ends of the two inner cranks 34 are pivotally attached onto one ends of the two outer cranks 35 with the use of an axle member 36. Another ends of the two outer cranks 35 are pivotally attached onto the two pedals 33 in order to allow the driving wheel 32 to be driven by the two pedals 33 to rotate. Furthermore, as shown in FIG. 1 and FIG. 3, the driving unit 30 further includes two handle bars 37 and two linkage bars 38. The two handle bars 37 are pivotally attached onto the two left and right sides of the column 22. The front end of the two linkage bars 38 are pivotally attached onto the bottom end of the two handle bars 37, and the rear ends of the two linkage bars 38 are pivotally attached onto the axle member 36 and positioned between the two inner cranks 34 and the two outer cranks 35, such that the two linkage bars 38 can follow the actions of the two pedals 33 in order to drive the two handle bars 37 to swing forward and backward.

The wind resistance wheel 40 uses a hub 42 for installing onto the front supporting plate 24 of the chassis 20, as shown in FIG. 10, in order to provide the wind resistance effect.

Figure 5:
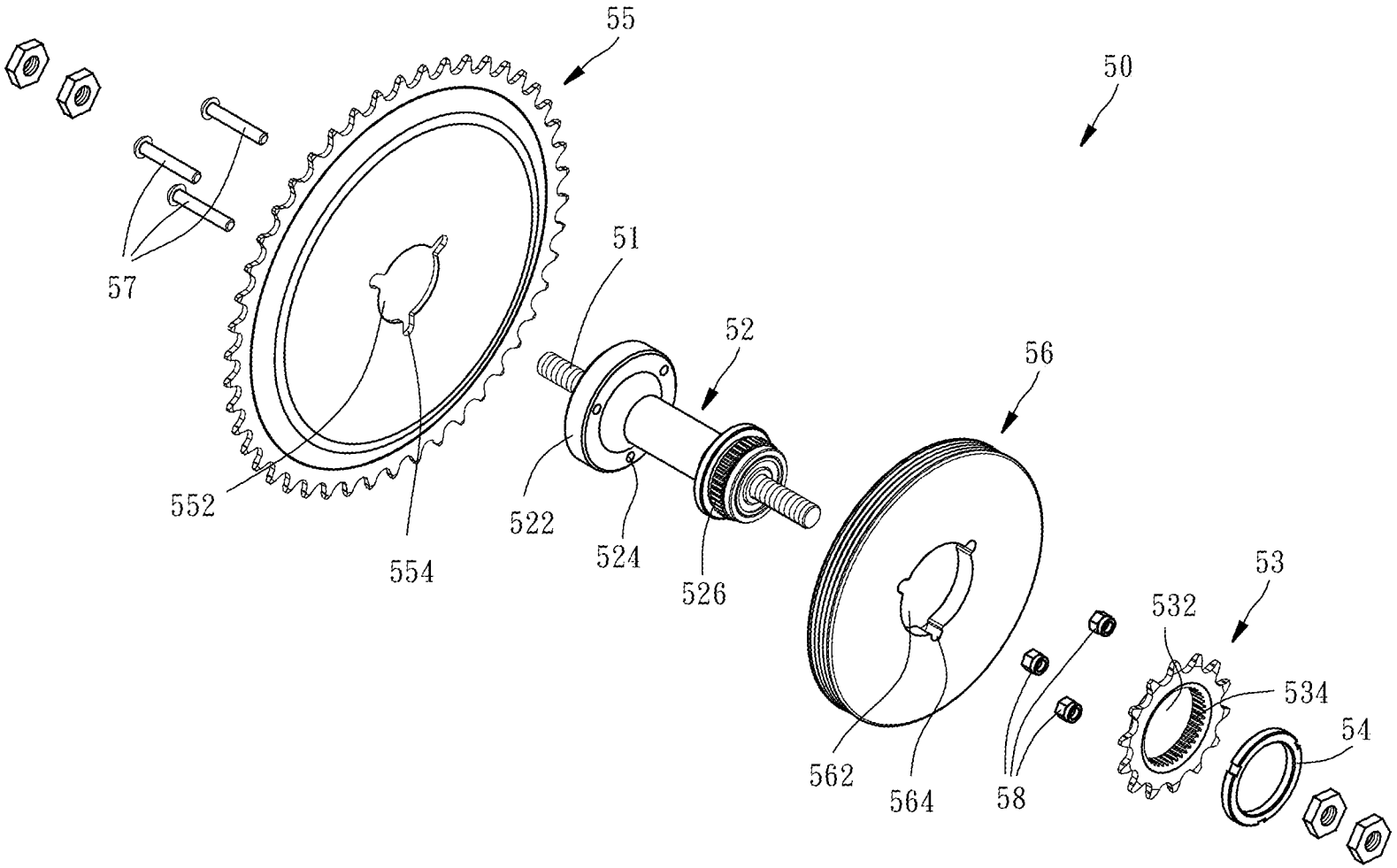
FIG. 5 is a partial perspective exploded view of the transmission unit provided by the present invention.
Figure 6:
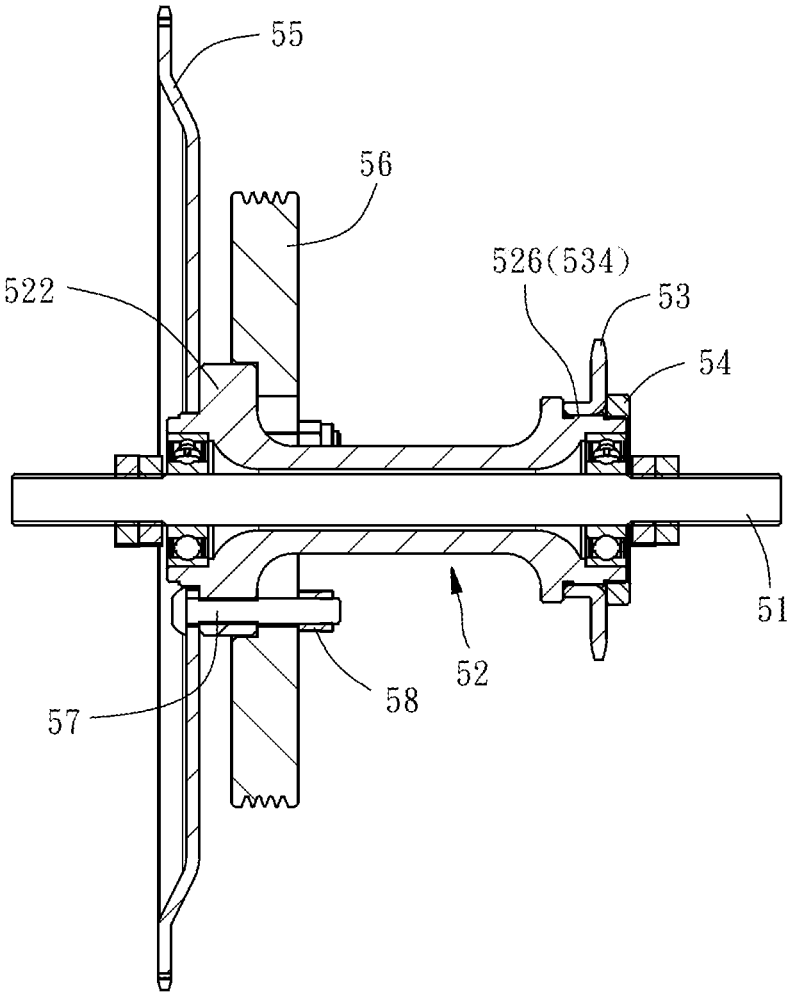
FIG. 6 is an assembly cross-sectional view of the transmission unit provided by the present invention.

The transmission unit 50 includes a supporting axle 51, a transmission sleeve 52, a first sprocket wheel 53, a second sprocket wheel 55, a belt pulley 56 and a transmission belt 61, as shown in FIG. 5 and FIG. 6.

In addition, the two ends of the supporting axle 51 use fixation elements, such as nuts etc., for securing onto the central supporting plate 25 of the chassis 20.

Transmission sleeve 52 is rotatably mounted onto the supporting axle 51. The left end of the transmission sleeve 52 includes a disk portion 522. The disk portion 522 includes three through holes 524. The right end of the transmission sleeve 52 includes an outer ring teeth portion 526.

The first sprocket wheel 53 includes a first axle hole 532. The first sprocket wheel 53 uses the first axle hole 532 for mounting onto the right end of the transmission sleeve 52 and uses a retaining ring 54 to position the first sprocket wheel 53 in order to prevent slippage thereof. The hole wall of the first axle hole 532 includes an inner ring teeth portion 534. The first sprocket wheel 53 uses the inner ring teeth portion 534 for engaging with the outer ring teeth portion 526 of the transmission sleeve 52 in order to allow the first sprocket wheel 53 and the transmission sleeve 52 to be actuated simultaneously. Moreover, the first sprocket wheel 53 uses a first chain 59 for connecting to the driving wheel 32 (as shown in FIG. 3) in order to allow the first sprocket wheel 53 to be driven by the driving wheel 32 for synchronous actuation.

The second sprocket wheel 55 includes a second axle hole 552. The second sprocket wheel 55 uses the second axle hole 552 for mounting onto the left end of the transmission sleeve 52. The belt pulley 56 includes a third axle hole 562. The belt pulley 56 uses the third axle hole 562 for mounting onto the left end of the transmission sleeve 52 and are positioned at the two left and right sides of the disk portion 522 with the second sprocket wheel 55. In addition, the hole wall of the second axle hole 552 of the second sprocket wheel 55 includes three first grooves 554. The hole wall of the third axle hole 562 of the belt pulley 56 includes three second grooves 564. Three bolts 57 are used to penetrate through the three first grooves 554 of the second sprocket wheel 55, the three through holes 524 of the disk portion 522 of the transmission sleeve 52 and the three second grooves 564 of the belt pulley 56. Then, three fixation nuts 58 are used for fastening the three bolts 57 and abutting against one side of the belt pulley 56 facing toward the first sprocket wheel 53, allowing the second sprocket wheel 55, the transmission sleeve 52 and the belt pulley 56 to be actuated synchronously.

In addition, the second sprocket wheel 55 uses a second chain 60 for connecting to the hub 42 of the wind resistance wheel 40 (as shown in FIG. 3 and FIG. 10) in order to allow the two to be actuated synchronously. The belt pulley 56 uses a transmission belt 61 for connecting to a flywheel 72 (details of the connection relationship is as described in the following) in order to allow the two to be actuated synchronously. Accordingly, as shown in FIG. 2, FIG. 3, FIG. 10 and FIG. 11, when the driving wheel 32 rotates, it is able to drive the first sprocket wheel 53 via the first chain 59. Next, the first sprocket wheel 53 drives the second sprocket wheel 55 and the belt wheel 56 via the transmission sleeve 52, such that in one aspect, it is able to allow the second sprocket wheel 55 to drive the wind resistance wheel 40 via the second chain 60, and in another aspect, it is able to allow the belt pulley 56 to drive the flywheel 72 via the transmission belt 61.

Figure 7:
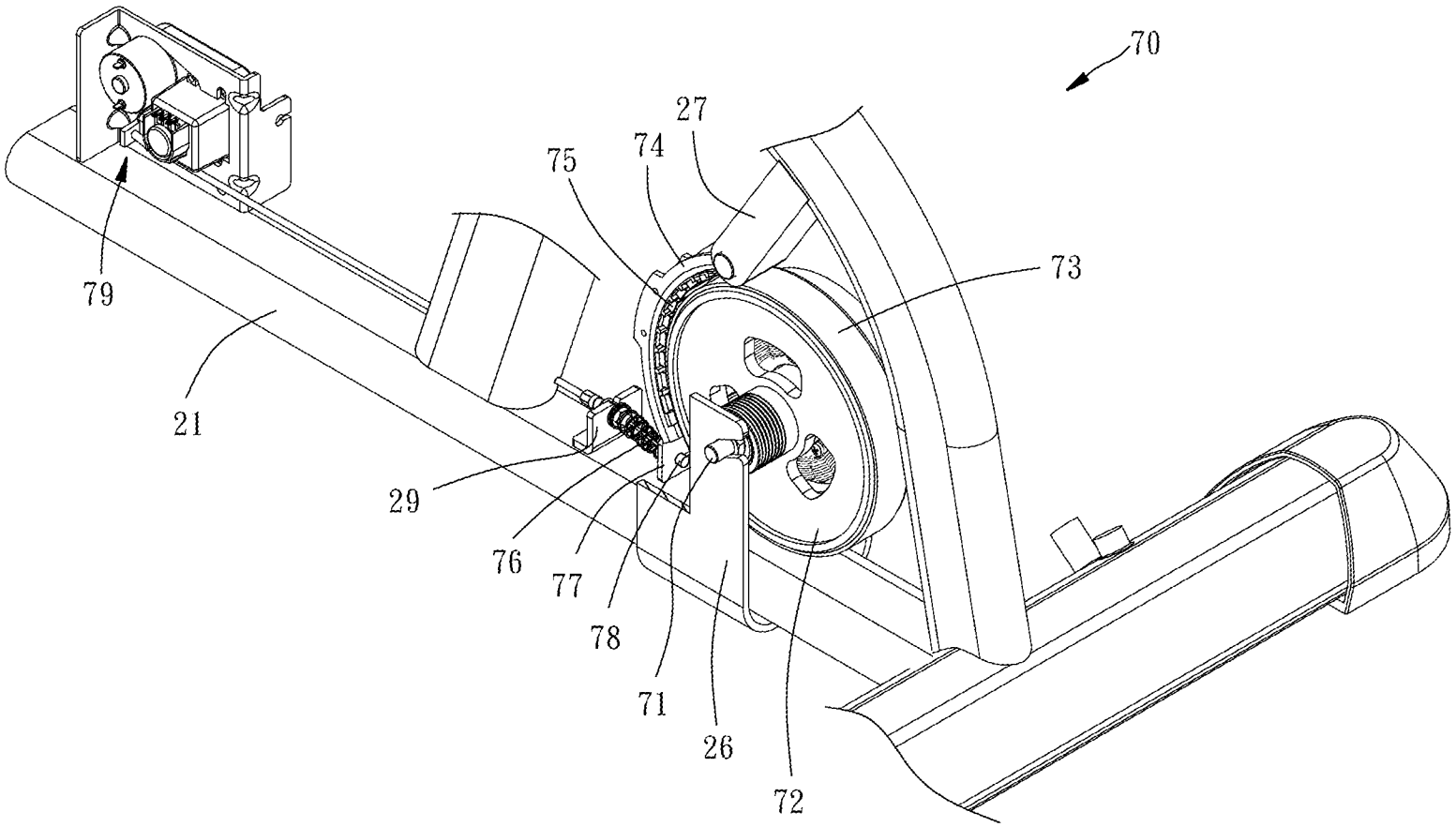
FIG. 7 is a perspective view of the resistance unit provided the present invention.

As shown in FIG. 7 and FIG. 10, the resistance unit 70 includes a mandrel 71, a flywheel 72, a magnetic ring 73, a magnet securement rack 74, a plurality of first magnets 75, an elastic member 76 (referring to a compression spring in this embodiment) and a cable 78.

Figure 2:
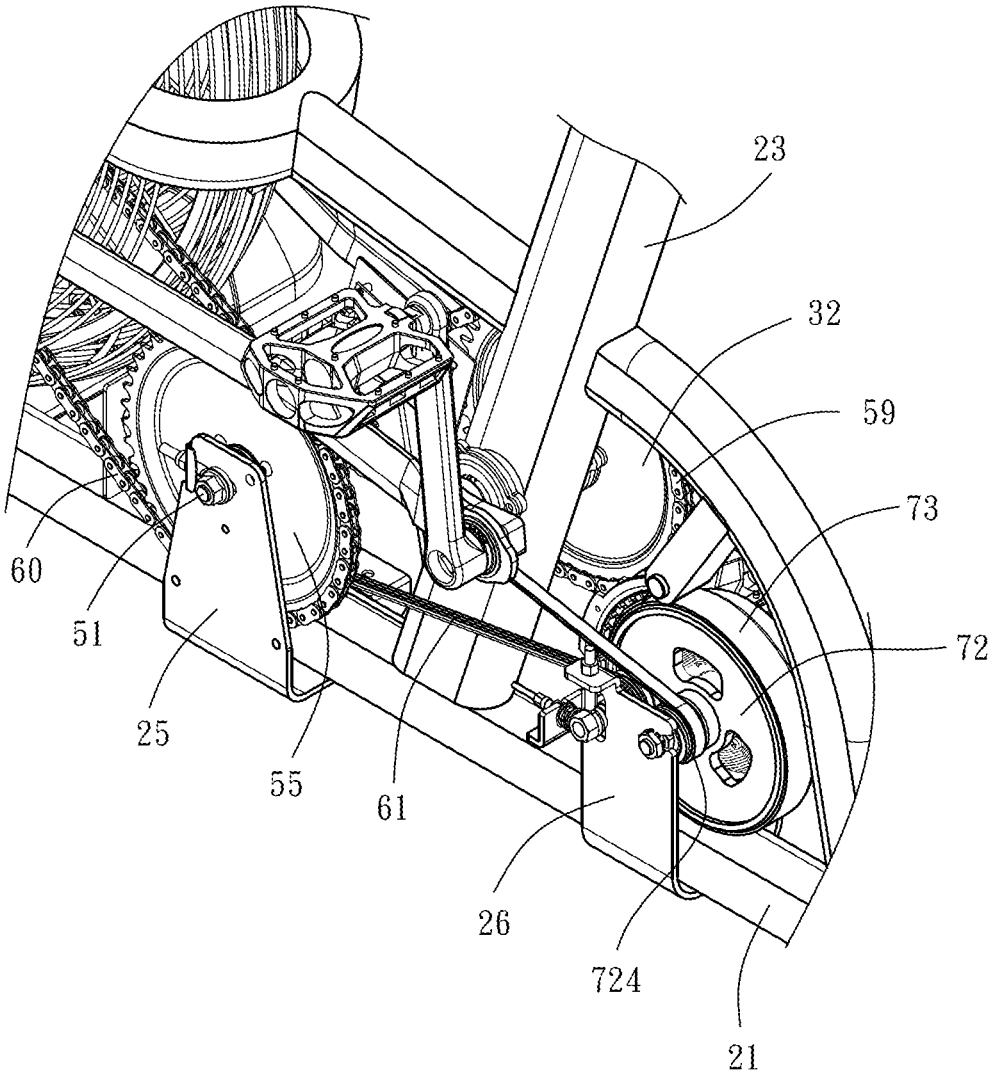
FIG. 2 is a partially enlarged view of the fan vehicle without the outer casing of the present invention.
Figure 9:
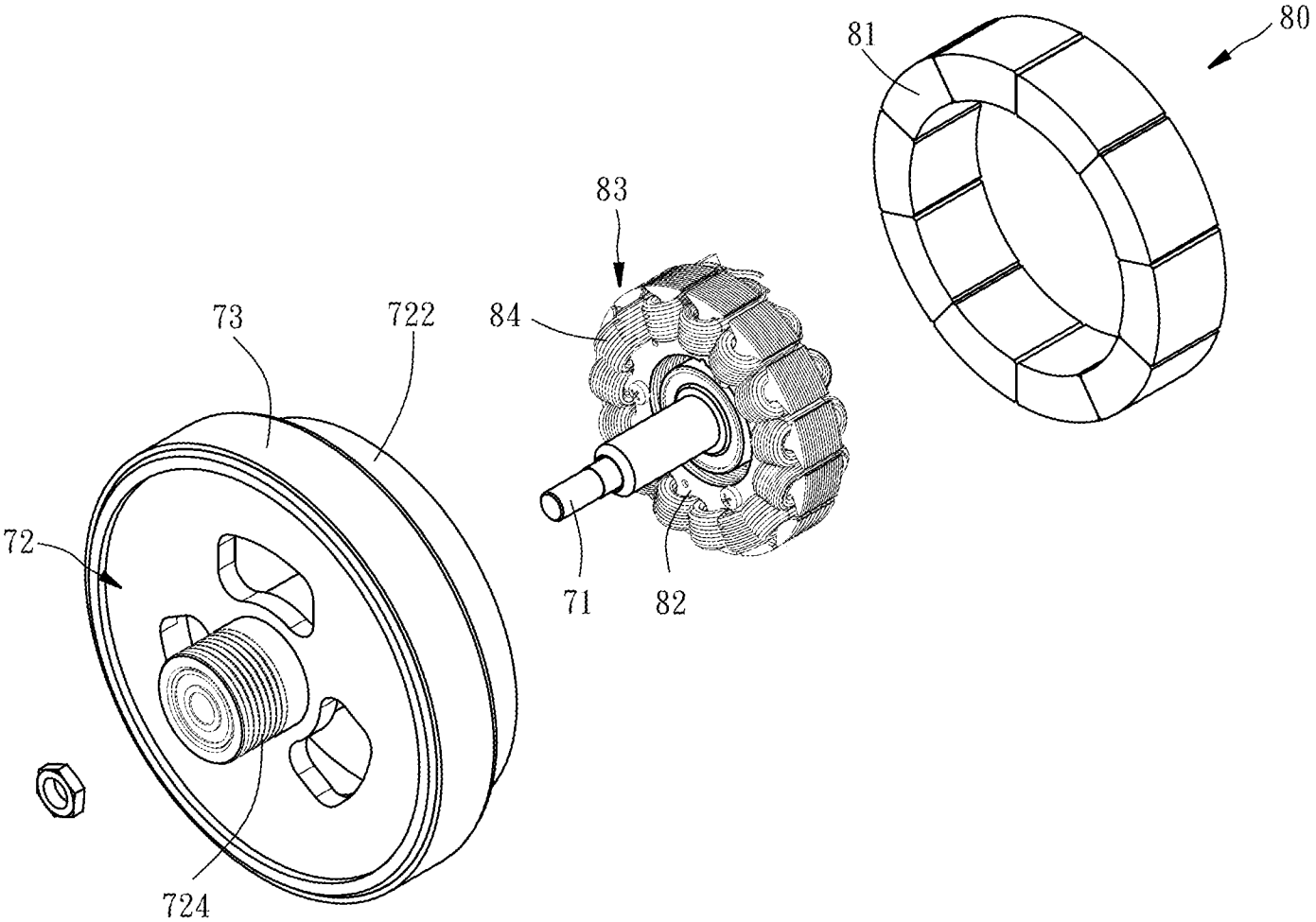
FIG. 9 is a partial perspective exploded view of the power generation unit provided by the present invention.
Figure 11:
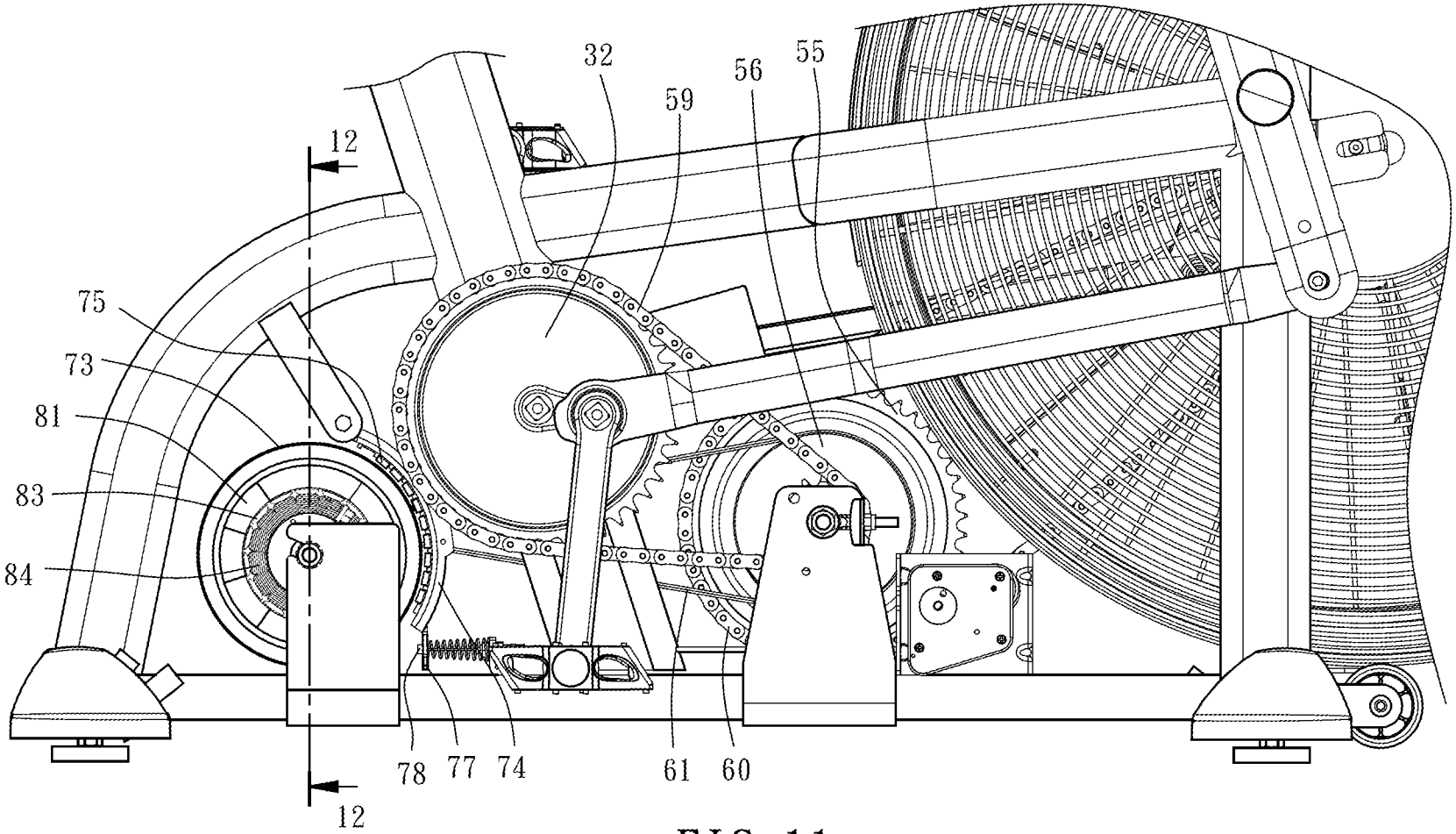
FIG. 11 is a partially enlarged right view of the fan vehicle without the outer casing of the present invention.

In addition, the two ends of the mandrel 71 are secured onto the rear supporting plate 26. The flywheel 72 is rotatably installed on the mandrel 71. The right side of the flywheel 72 includes a protruding ring portion 722 (as shown in FIG. 9), and the left side of the flywheel 72 includes a transmission axle portion 724 (as shown in FIG. 9). The transmission axle portion 724 of the flywheel 72 uses the transmission belt 61 for connecting to the belt pulley 56 (as shown in FIG. 2, FIG. 10 and FIG. 11) in order to allow the flywheel 72 to be driven together by the belt pulley 56. The magnetic ring 73 is secured onto the outer circumferential surface of the flywheel 72 in order to allow the magnetic ring 73 to be actuated together with the flywheel 72. The magnet securement rack 74 is positioned at an outer perimeter of the magnetic ring 73, and the top end of the magnet securement rack 74 is pivotally attached onto a slanted bar 27 of the chassis 20. The plurality of first magnets 75 are arranged spaced apart from each other on one side of the magnet securement rack 74 facing toward the magnetic ring 73 and forming a gap away from the magnetic ring 73. The rear end of the elastic member 76 abuts against a supporting plate 29, and the supporting plate 29 is secured onto the base 21. The front end of the elastic member 76 abuts against a linkage plate 77, and the linkage plate 77 is secured onto the bottom end of the magnet securement rack 74 in order to allow the elastic member 76 to provide an elastic force for pushing the magnet securement rack 74 toward the direction of the magnetic ring 73. The front end of the cable 78 penetrates through the elastic member 76 and is locked onto the linkage plate 77. The rear end of the cable 78 is connected to a power source 79 (such as a motor), allowing the cable 78 to be driven by the power source 79 in order to drive the linkage plate 77. The linkage plate 77 then pulls the magnet securement rack 74 toward the direction away from the magnetic ring 73.

In view of the above, it can be understood that when the magnetic ring 73 rotates together with the flywheel 72 such that when the magnetic field generated at the surrounding of the plurality of first magnets 75 is dissected, the distance of the magnet securement rack 74 relative to the magnetic ring 73 can be changed in order to adjust the strength of the magnetic field in order to allow the resistance unit 70 to provide resistance effect of different level to the flywheel 72.

Figure 8:
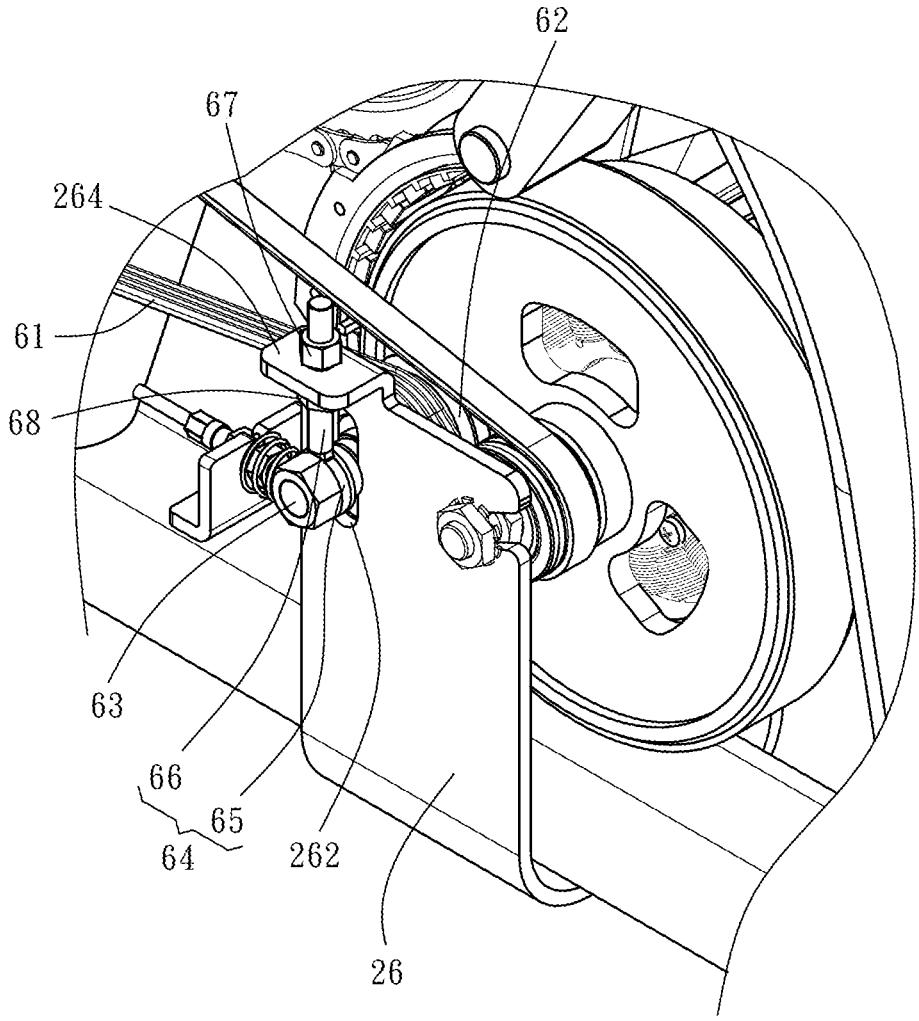
FIG. 8 is a partially enlarged view of FIG. 2.

To enhance the transmission effect between the belt pulley 56 and the flywheel 72, as shown in FIG. 8, the rear supporting plate 26 of the chassis 20 includes a linear hole 262 and a retaining portion 264 positioned on the linear hole 262. The transmission unit 50 further provides an idler wheel 62, an adjustment member 64, an adjustment nut 67 and a retaining nut 68. The idler wheel 62 is rotatably installed on a wheel axle 63. The wheel axle 63 penetrates into the linear hole 262 to move upward and downward therein. The adjustment member 64 includes a collar 65 and a screw shaft 66 connected to the collar 65; wherein the collar 65 is mounted onto the wheel axle 63. The screw shaft 66 penetrates into the retaining portion 264 of the rear supporting plate 26 to move upward and downward therein. The adjustment nut 67 is fastened onto the screw shaft 66 and positioned on top of the retaining portion 264 of the rear supporting plate 26. The retaining nut 68 is fastened on the screw shaft 66 and positioned underneath the retaining portion 264 of the rear supporting plate 26. Accordingly, the screw shaft 66 of the adjustment member 64 can be driven by simply rotating the adjustment nut 67 in order to allow the adjustment member 64 to drive the wheel axle 63 via the collar 65 to move upward and downward along the linear hole 262 together with the idler wheel 62. Consequently, it is able to adjust the force of the idler wheel 62 abutting against the transmission belt 61 in order to allow further adjust the tension of the transmission belt 61.

Figure 12:
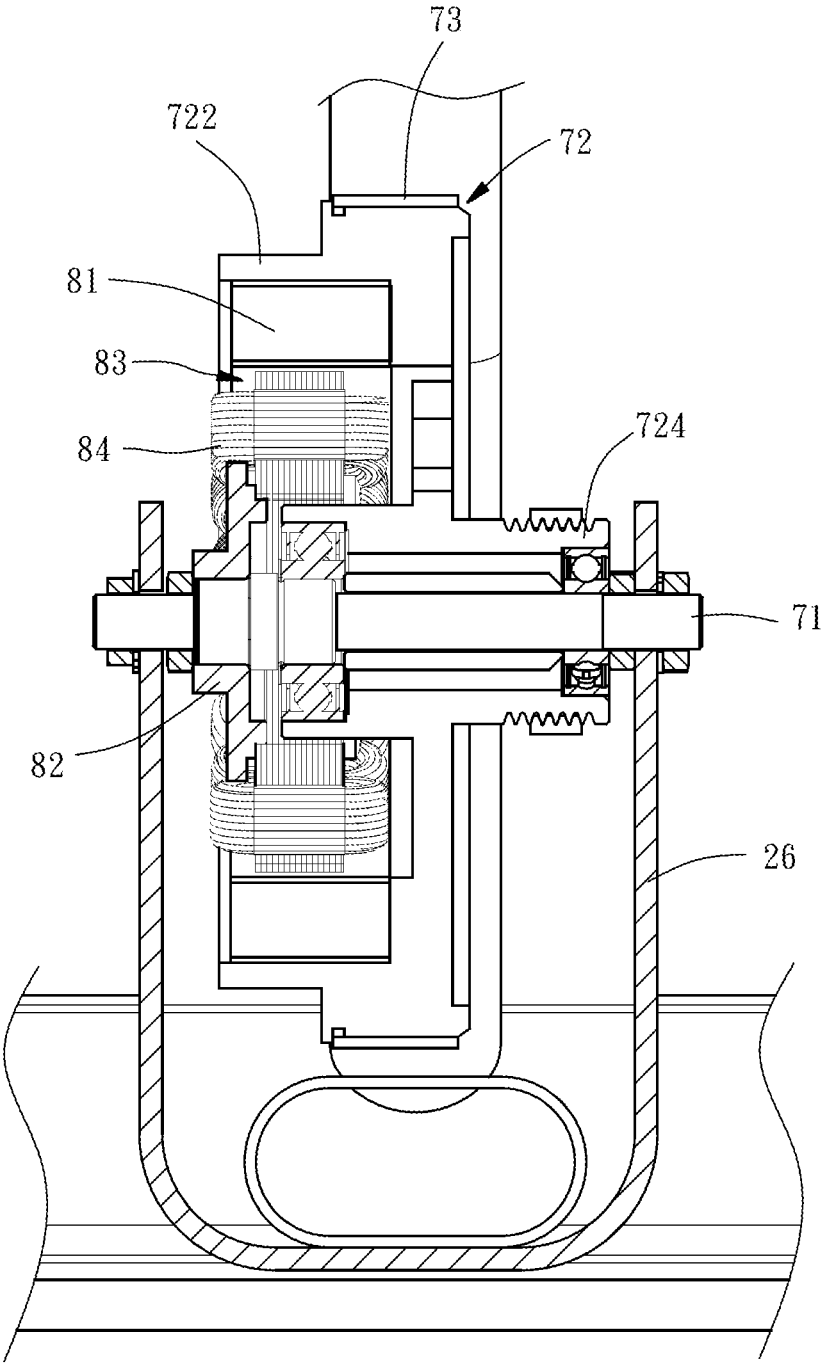
FIG. 12 is a cross-sectional view along the sectional line 12-12 in FIG. 11.

The power generating unit 80 includes a plurality of second magnets 81, a supporting rack 82 and a plurality of cores 83, as shown in FIG. 9, FIG. 11 and FIG. 12. The plurality of second magnets 81 (not limited to any quantity, and a quantity of 10 magnets is used as an example for illustration) are arranged in parallel horizontally (arranged in the cyclic method of N-S-N-S) inside the protruding ring portions 722 of the idler wheel 72 and are arranged in a ring shape relative to the mandrel 71. The supporting rack 82 is secured onto the mandrel 71 and maintained stationary. The plurality of cores 83 are constructed by a plurality of silicon steel plates stacking in layers. The plurality of cores 83 are spaced apart from each other and arranged in a ring shape on the outer circumferential edge of the supporting rack and are wounded by a set of coils 84. A gap is formed between the plurality of cores 83 and the plurality of first magnets 81.

According to the above, it can be understood that when the plurality of second magnets 81 rotates along with the idler wheel 72 relative to the plurality of coils 84, the plurality of coils 84 are able to generate induced current. After the aforementioned induced current is rectified and filtered, it can be supplied to the desired equipment for use.

In view of the above, the fan vehicle 10 of the present invention uses both the wind resistance and magnetic resistance in combination such that it is able to allow users to perform high intensity and diverse trainings as well as allow users to set up the level of the magnetic resistance according to one's individual needs. For example, at the location where a maximum torque is applied to the inner and outer cranks 34, 35, the magnetic resistance is set to be the maximum. On the contrary, at the location where a minimum torque is applied to the inner and outer cranks 34, 35, the magnetic resistance is set to be the minimum Consequently, it is able to allow users to achieve the training of low rotational speed and high power more easily. Furthermore, the configuration of the power generating unit 80 is able to achieve the effect of self-generating electricity.

What is claimed is:

1. A fan vehicle, comprising:

a chassis:

a driving unit having a crankshaft, a driving wheel, two pedals and two cranks; the crankshaft rotatably installed on the chassis; the driving wheel secured onto the crankshaft and positioned on one side of the chassis; first ends of the two cranks connected to the crankshaft and second ends of the two cranks connected to the two pedals;

a wind resistance wheel rotatably installed on the chassis and positioned at a front of the driving unit;

a transmission unit connected to the driving wheel and the wind resistance wheel and configured to transmit a driving force generated by the driving wheel to the wind resistance wheel, thereby allowing the wind resistance wheel to rotate with the driving wheel synchronously;

a resistance unit having a mandrel, a flywheel, a magnetic ring, a magnet securement rack, a plurality of first magnets, an elastic member and a cable; the mandrel installed on the chassis and positioned at a rear of the driving unit; the flywheel rotatably installed on the mandrel and connected to the transmission unit; the magnetic ring secured onto an outer circumferential surface of the flywheel; the magnet securement rack positioned at an outer perimeter of the magnetic ring, and a top end of the magnet securement rack pivotally attached onto the chassis; the plurality of first magnets arranged spaced apart from each other on one side of the magnet securement rack facing toward the magnetic ring and forming a gap away from the magnetic ring; the elastic member acting on a bottom end of the magnet securement rack and exerting an elastic force on the magnet securement rack to push toward a direction of the magnetic ring; one end of the cable connected to the bottom end of the magnet securement rack and configured to provide a traction force to pull the magnet securement rack in a direction away from the magnetic ring; and a power generating unit having a plurality of second magnets, a supporting rack, a plurality of cores and a plurality coils; the plurality of second magnets installed inside the flywheel and arranged in a ring shape relative to the mandrel; the supporting rack secured onto the mandrel and positioned inside the flywheel; the plurality of cores installed on an outer circumferential edge of the supporting rack and forming a gap away from an inner circumferential surface of the plurality of second magnets; the plurality of coils wounded onto the plurality of cores one-to-one respectively.

2. The fan vehicle according to claim 1, wherein the transmission unit includes a supporting axle, a transmission sleeve, a first sprocket wheel, a first chain, a second sprocket wheel, a second chain, a belt pulley and a transmission belt; the supporting axle is secured onto the chassis; the transmission sleeve is rotatably installed on the supporting axle; the first sprocket wheel and the second sprocket wheel are connected to two ends of the transmission sleeve and positioned between the driving wheel and the wind resistance wheel; the first chain is connected to the driving wheel and the first sprocket wheel; the second chain is connected to the wind resistance wheel and the second sprocket wheel; the belt pulley is positioned at the second sprocket wheel and facing toward one side of the first sprocket wheel and connected to one end of the transmission sleeve; the transmission belt is connected to the flywheel and the belt pulley.

3. The fan vehicle according to claim 2, wherein one end of the transmission sleeve includes an outer ring teeth portion; the first sprocket wheel includes a first axle hole provided for the transmission sleeve to penetrate therethrough; a hole wall of the first axle hole includes an inner ring teeth portion; the inner ring teeth portion of the first sprocket wheel engages with the outer ring teeth portion of the transmission sleeve.

4. The fan vehicle according to claim 2, wherein one end of the transmission sleeve includes a disk portion; the disk portion includes a through hole; the second sprocket wheel includes a second axle hole provided for the transmission sleeve to penetrate therethrough; a hole wall of the second axle hole includes a first groove; the belt pulley includes a third axle hole provided for a ring portion of the transmission sleeve to penetrate therethrough; a hole wall of the third axle hole includes a second groove; the transmission unit further includes a bolt and a fixation nut; the bolt is locked onto the first groove of the second sprocket wheel and the second groove of the belt pulley and penetrates into the through hole of the transmission sleeve; the fixation nut is fastened onto the bolt and abuts against the belt pulley.

5. The fan vehicle according to claim 2, wherein the transmission unit further comprises an idler wheel; the idler wheel is rotatably installed on the chassis and is adjacent to the flywheel, and abuts against the transmission belt.

6. The fan vehicle according to claim 5, wherein left and right ends of the mandrel include a rear supporting plate secured thereon; the rear supporting plate includes a linear hole and a retaining portion positioned at a top of the linear hole; the idler wheel is rotatably installed on a wheel axle; the wheel axle penetrates into the linear hole to move upward and downward therein; the transmission unit further includes an adjustment member, an adjustment nut and a retaining nut; the adjustment member includes a collar and a screw shaft connected to the collar; the collar of the adjustment member is mounted onto the wheel axle; the screw shaft of the adjustment member penetrates into the retaining portion of the rear supporting plate to move upward and downward therein; the adjustment nut is fastened onto the screw shaft and positioned on top of the retaining portion of the rear supporting plate; the retaining nut is fastened on the screw shaft and positioned underneath the retaining portion of the rear supporting plate.

* * * * *